US009272815B2

(12) United States Patent
Uptergrove

(10) Patent No.: US 9,272,815 B2
(45) Date of Patent: Mar. 1, 2016

(54) DIGITAL PRINTING PLASTIC CONTAINER

(71) Applicant: Plastipak Packaging, Inc., Plymouth, MI (US)

(72) Inventor: Ronald L. Uptergrove, Northville, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 13/799,521

(22) Filed: Mar. 13, 2013

(65) Prior Publication Data

US 2013/0193022 A1 Aug. 1, 2013

Related U.S. Application Data

(60) Continuation-in-part of application No. 12/604,557, filed on Oct. 23, 2009, now Pat. No. 8,579,402, which is a division of application No. 11/562,655, filed on Nov. 22, 2006, now Pat. No. 7,625,059, application No. 13/799,521, which is a continuation-in-part of application No. 11/716,447, filed on Mar. 9, 2007, now Pat. No. 8,522,989.

(60) Provisional application No. 60/798,900, filed on May 9, 2006, provisional application No. 61/644,881, filed on May 9, 2012.

(51) Int. Cl.

| | |
|---|---|
| ***B41J 29/38*** | (2006.01) |
| ***B65D 25/00*** | (2006.01) |
| ***B41J 2/175*** | (2006.01) |
| ***B41J 3/407*** | (2006.01) |
| ***B41J 29/377*** | (2006.01) |

(52) U.S. Cl.

CPC ..... *B65D 25/00* (2013.01); *B41J 2/175* (2013.01); *B41J 2/17509* (2013.01); *B41J 2/17513* (2013.01); *B41J 3/4073* (2013.01); *B41J 29/377* (2013.01)

(58) Field of Classification Search

USPC ..... 347/16, 4, 105

See application file for complete search history.

(56) References Cited

U.S. PATENT DOCUMENTS

| | | | |
|---|---|---|---|
| 1,832,501 | A | 11/1931 | Pittenger et al. |
| 3,417,175 | A | 12/1968 | Brown et al. |
| 3,490,363 | A | 1/1970 | Derrickson |

(Continued)

FOREIGN PATENT DOCUMENTS

| | | | |
|---|---|---|---|
| DE | 102004032058 | | 12/2009 |
| EP | 0088630 | A2 | 9/1983 |

(Continued)

OTHER PUBLICATIONS

ISA/US Commissioner for Patents, International Search Report and Written Opinion issued in corresponding International Application No. PCT/US2013/040359. Date of Mailing: Sep. 4, 2013.

(Continued)

*Primary Examiner* — Lamson Nguyen

(74) *Attorney, Agent, or Firm* — Dykema Gossett PLLC

(57) ABSTRACT

A plastic container includes a medium applied to a portion of the container. A digital image is applied to a portion of the medium, the digital image being comprised of a plurality of ink droplets. Methods for digital printing on a portion of a medium that is applied to a container are also disclosed.

22 Claims, 2 Drawing Sheets

(56) References Cited

U.S. PATENT DOCUMENTS

| | | | | |
|---|---|---|---|---|
| 3,999,190 | A | 12/1976 | Brown et al. | |
| 4,074,279 | A | 2/1978 | Ikeda et al. | |
| 4,519,310 | A | 5/1985 | Shimizu et al. | |
| 4,914,451 | A | 4/1990 | Morris et al. | |
| 5,011,862 | A | 4/1991 | Melber et al. | |
| 5,182,571 | A | 1/1993 | Creagh et al. | |
| 5,411,140 | A | 5/1995 | Byer | |
| 5,528,280 | A | 6/1996 | Endo et al. | |
| 5,624,743 | A | 4/1997 | Malhotra | |
| 5,753,325 | A | 5/1998 | McDaniel | |
| 5,815,282 | A | 9/1998 | Kano | |
| 5,858,514 | A | 1/1999 | Bowers | |
| 5,984,456 | A | 11/1999 | Bern | |
| 6,002,844 | A | 12/1999 | Kishida et al. | |
| 6,082,563 | A | 7/2000 | Kohn et al. | |
| 6,135,654 | A | 10/2000 | Jennel | |
| 6,194,043 | B1 | 2/2001 | Fehn | |
| 6,235,358 | B1 | 5/2001 | Goto et al. | |
| 6,406,115 | B2 | 6/2002 | Mantell et al. | |
| 6,409,294 | B1 | 6/2002 | Zimmermann et al. | |
| 6,435,655 | B1 | 8/2002 | Yoshihira | |
| 6,460,991 | B1 | 10/2002 | Temple et al. | |
| 6,493,677 | B1 | 12/2002 | von Rosen et al. | |
| 6,513,435 | B2 | 2/2003 | Detzner | |
| 6,527,133 | B1 | 3/2003 | McCollum et al. | |
| 6,550,905 | B1 | 4/2003 | Deckers | |
| 6,578,476 | B2 | 6/2003 | Liguori | |
| 6,655,798 | B2 | 12/2003 | Temple | |
| 6,682,191 | B2 | 1/2004 | Temple et al. | |
| 6,699,352 | B2 | 3/2004 | Sawatsky | |
| 6,705,218 | B2 | 3/2004 | Rapp | |
| 6,706,342 | B2 | 3/2004 | Kong et al. | |
| 6,749,913 | B2 | 6/2004 | Watanabe et al. | |
| 6,769,357 | B1 | 8/2004 | Finan | |
| 6,837,376 | B2 | 1/2005 | Pauli | |
| 6,845,365 | B2 | 1/2005 | von Rosen et al. | |
| 7,128,406 | B2 | 10/2006 | Dixon et al. | |
| 7,133,058 | B2 | 11/2006 | Lee | |
| 7,162,325 | B2 * | 1/2007 | Silverbrook | 700/119 |
| 7,182,418 | B2 | 2/2007 | Harvey et al. | |
| 7,210,408 | B2 | 5/2007 | Uptergrove | |
| 7,579,388 | B2 | 8/2009 | Kiefer | |
| 7,597,933 | B2 | 10/2009 | Muraoka | |
| 7,625,059 | B2 | 12/2009 | Uptergrove | |
| 7,736,713 | B2 | 6/2010 | Uptergrove | |
| 7,891,490 | B2 | 2/2011 | Raming | |
| 8,141,970 | B2 | 3/2012 | Noll | |
| 2002/0086914 | A1 | 7/2002 | Lee et al. | |
| 2002/0097280 | A1 | 7/2002 | Loper et al. | |
| 2003/0000909 | A1 | 1/2003 | Sakaguchi et al. | |
| 2003/0021961 | A1 | 1/2003 | Ylitalo | |
| 2004/0126507 | A1 | 7/2004 | O'Brien | |
| 2004/0200558 | A1 | 10/2004 | Stevens et al. | |
| 2005/0211371 | A1 | 9/2005 | Hirst et al. | |
| 2006/0115639 | A1 | 6/2006 | de Vries et al. | |
| 2006/0142415 | A1 | 6/2006 | Ylitalo et al. | |
| 2006/0250464 | A1 | 11/2006 | Sheinman | |
| 2007/0157559 | A1 | 7/2007 | Till | |
| 2007/0229497 | A1 | 10/2007 | Zinniel et al. | |
| 2008/0011177 | A1 | 1/2008 | Muraoka | |
| 2008/0117248 | A1 | 5/2008 | Uptergrove | |
| 2008/0186354 | A1 | 8/2008 | White | |
| 2008/0202370 | A1 | 8/2008 | Muraoka | |
| 2008/0252671 | A1 | 10/2008 | Cannell et al. | |
| 2009/0160901 | A1 | 6/2009 | Achhammer | |
| 2009/0276088 | A1 | 11/2009 | Ruddy | |
| 2010/0038339 | A1 | 2/2010 | Uptergrove | |
| 2010/0200451 | A1 | 8/2010 | Uptergrove | |
| 2011/0132916 | A1 | 6/2011 | Uptergrove et al. | |
| 2011/0154626 | A1 | 6/2011 | VanDenBogart | |

FOREIGN PATENT DOCUMENTS

| | | | |
|---|---|---|---|
| EP | 0209896 | A2 | 1/1987 |
| EP | 0385624 | A1 | 9/1990 |
| EP | 0657849 | A2 | 6/1994 |
| EP | 1435296 | A1 | 7/2004 |
| EP | 1586459 | A1 | 10/2005 |
| EP | 1671804 | A1 | 6/2006 |
| JP | 5330402 | | 3/1978 |
| JP | 55-176136 | | 12/1980 |
| JP | 62-221472 | A | 9/1987 |
| JP | 08-072885 | | 3/1996 |
| JP | 2000281031 | | 10/2000 |
| JP | 2004244077 | A | 9/2004 |
| JP | 2005119097 | A | 5/2005 |
| JP | 2005119243 | A | 5/2005 |
| JP | 2005283968 | A | 10/2005 |
| JP | 2005313457 | A | 11/2005 |
| WO | 9908935 | A1 | 2/1999 |
| WO | 99/20468 | A1 | 4/1999 |
| WO | 03/002349 | A2 | 1/2003 |
| WO | 2004009360 | A1 | 1/2004 |
| WO | 2004/043702 | A1 | 5/2004 |
| WO | 2009157613 | A1 | 12/2009 |

OTHER PUBLICATIONS

Steven H. Johnson; "Ink-Jet Printing System—An Analytical Computer Model"; IEEE Transactions on Industry Applications, vol. 1A-12, No. 3, May/Jun. 1976, pp. 294-305.

Jianying Shang, et al.; "Comparison of Different Methods to Measure Contact Angles of Soil Colloids"; Journal of Colloid and Interface Science, 328 (2008), pp. 299-307.

Agfa-Gevaert; "Universal Print Head" Brochure, 2005.

* cited by examiner

DIGITAL PRINTING PLASTIC CONTAINER

CROSS-REFERENCE TO RELATED APPLICATIONS

This applications claims the benefit of priority to U.S. Provisional Patent application 61/644,881, filed May 9, 2012. This application is also a continuation-in-part of and claims priority to U.S. patent application Ser. No. 12/604,557, filed Oct. 23, 2009, which is a divisional of and claims priority to U.S. patent application Ser. No. 11/562,655, filed Nov. 22, 2006, the entire contents of which are hereby incorporated by reference as though fully set forth herein. This application is also a continuation-in-part of and claims priority to U.S. patent application Ser. No. 11/716,447, filed Mar. 9, 2007, which claims priority to U.S. Provisional Patent Application 60/798,900, filed May 9, 2006, the entire contents of which are also hereby incorporated by reference as though fully set forth herein.

TECHNICAL FIELD

The present invention relates generally to plastic containers having digital images printed thereon, including containers with curved surfaces, and methods for printing images on plastic containers.

BACKGROUND

Conventional techniques for printing onto curved surface plastic containers are subject to certain limitations and drawbacks. Such techniques make it difficult to provide a container, particularly a container having a non-planar surface, with an image that is commercially acceptable. Another challenge can be to provide a base coat or surface for subsequent digital printing in an efficient and cost-effective manner. A further challenge, is to efficiently provide a container with a multi-color digital image printed at acceptable speeds and at a reasonable cost.

SUMMARY

A plastic container includes a medium that is applied to a portion of the container. A digital image is applied to a portion of the medium, the digital image is comprised of a plurality of ink droplets. Methods for digital printing on a portion of a medium that is applied to a container are also disclosed.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present disclosure, examples of which are described herein and illustrated in the accompanying drawings. Additional descriptions and information are provided in connection with U.S. patent application Ser. Nos. 12/604,557, 11/562,655, 11/716,447, and 60/798,900, which are each incorporated by reference herein in their entirety. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
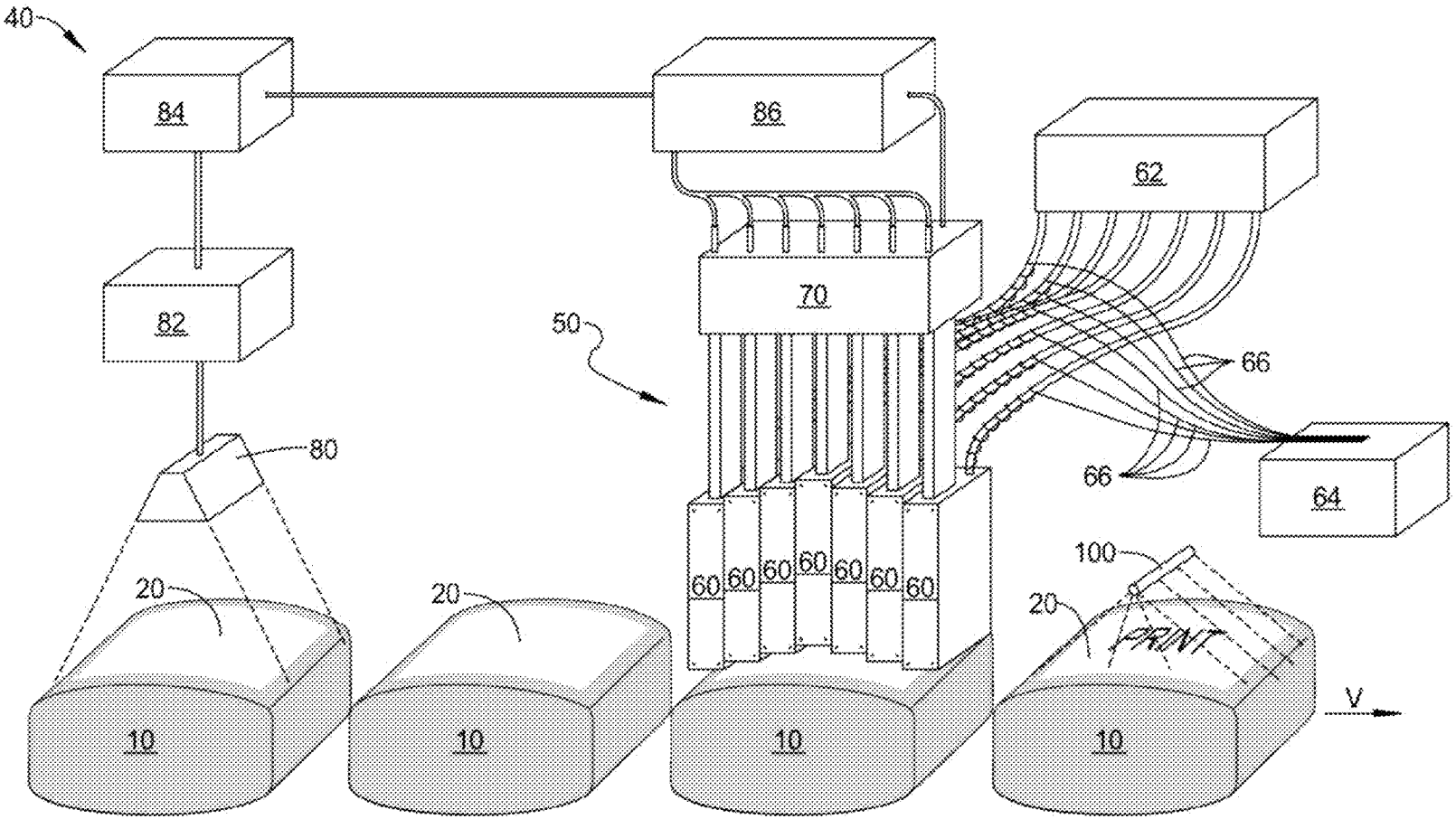
FIG. 1 is a graphical representation of an ink droplet application system according to an embodiment of the disclosure.

An ink droplet application system 40 according to an embodiment of the disclosure is generally illustrated in FIG. 1. As generally illustrated, a plurality of containers 10, which may include a non-planar (e.g., oval, round, or simply generally curved) surface, may be transported or conveyed past a printing subsystem 50. The printing subsystem may comprise one or more print heads 60; at least one actuator 70 for controlling the up-down (or in-out) position of the print head or heads relative to the containers; some form of an ink delivery device 62 for delivering one or more types or colors of ink to one or more print heads. The system 40 may additionally include some form of temperature control device 64, which can serve to at least in part regulate or control the temperature of the ink, and may include a plurality of fluid lines 66.

In embodiments, if included, a temperature control device may include fluid heating units and one or more pumps that circulate heated water or other fluid. If desired, the fluid may be circulated in a closed circuit, and individual print heads 60 may be supplied with ink through ink lines that may include, for instance, a plurality of water lines. It is noted that the ink can be maintained at a temperature or a desired temperature range within the print heads for delivery of ink droplets to the surface of the container to be treated. In an embodiment, the ink can be maintained at a temperature in the print heads (i.e., just prior to dispersion or application) from about 40° C. to about 50° C.

As generally illustrated in FIG. 1, a plurality of containers 10 may be transported in succession, such as by a conveyor, or in a linear-type manner. However, it is important to note that the invention is not limited to such a single means or manner of conveyance or handling. The containers may be plastic containers, and may be formed by, for example, injection molding, blow molding, rotational molding, thermoforming and/or various other techniques known in the art.

As generally illustrated, each container 10 may include at least one medium 20. Although a single medium 20 is shown in connection with each of the illustrated containers, for embodiments, more than one medium 20 may be applied to one or more portions or positions on a single container 10. Without limitation, for embodiments, one or more medium 20 may be applied to opposing sides of the same container 10. The term "medium," as used herein, is intended to include various labels or printing substrates that can be applied or otherwise affixed to a portion of a plastic container. The medium 20 may be applied using various techniques that are known in the art. For example, and without limitation, the medium (or media) may be applied using in-mold labeling (IML), glue application (such as where a label is "stuck on" a surface of a container), pressure sensitive (e.g., self adhesive), and/or heat transfer labeling techniques.

The medium 20 may be white and otherwise uncoated, at least with respect to an outer/exposed surface. However, with embodiments, the medium 20 (or at least the outer/exposed surface thereof) may be clear or may be comprised of one or more colors. Further, for some embodiments, the medium 20 may include one or more pre-printed portions, along with one or more portions intended or available for post-application digital printing.

With continued reference to FIG. 1, a plurality of containers 10 may be transported in some manner to and past a printing subsystem 50. There are a number of manners for handling/presenting a container (or portion thereof) that are known in the art, and one or more of such techniques may be employed provided that the surface of the container to be printed upon (such as a medium 20 surface) is not operatively obstructed from the relevant/associated print heads 60, which may be independently movable and controlled. It is desirable that the position of the surface that is to be printed upon can be sufficiently established in space with respect to the printing subsystem so that the print heads 60 can be positioned to maintain a controlled distance from the surface. For example, without limitation, the containers may be temporarily retained in a fixture or holder, including without limitation a rotary-type device, including those known in the art, to move past the print heads.

Figure 2:
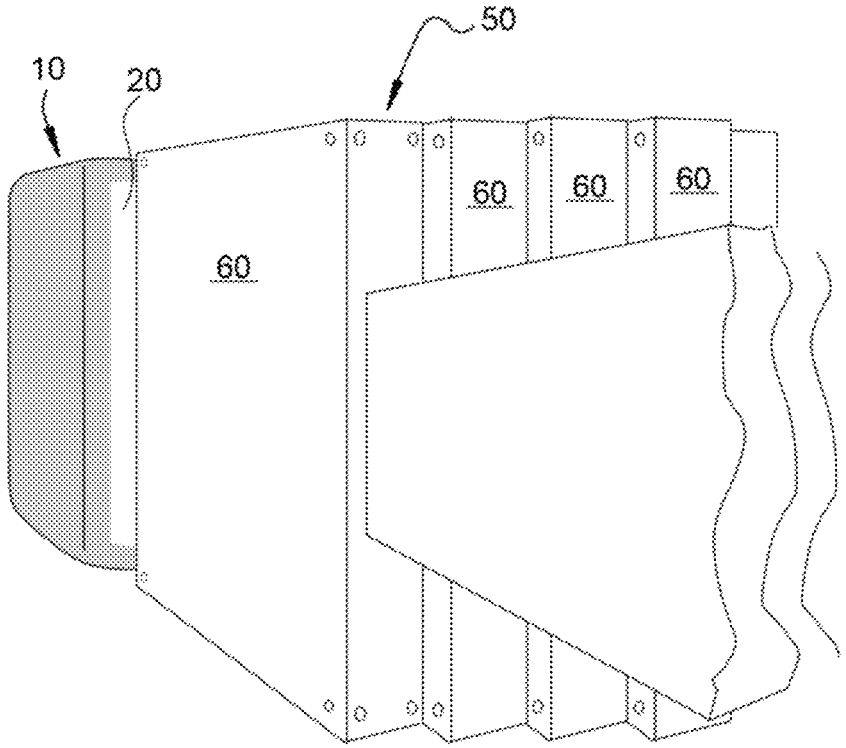
FIG. 2 is a graphical representation of a printing subsystem according to an embodiment of the disclosure.

For example, and without limitation, FIG. 2 generally illustrates an embodiment in which the printing subsystem 50 with print heads 60 that is configured for horizontal or "side" printing. For embodiments of some systems, a container 10 (such as illustrated) may progress past the printing subsystem 50 in a substantially vertical orientation. Moreover, if desired, a second printing subsystem may be provided for printing (e.g., simultaneous printing) on opposing sides of a single container 10.

As generally illustrated in FIG. 1, the system 40 may additionally include a scanning device 80, such as a laser scanner. The scanning device 80 can be used to scan each container surface that is to be printed upon prior to moving the container through the printing subsystem 50. The scanning device 80 can capture surface profile data for the surface of the container to be printed, including, for example, surface variability and curvature data, and/or confirm or verify the presence and positioning of one or more associated medium 20. In an embodiment, the scanning device data may be communicated to a signal conditioner 82, which may communicate data or instructions to a processor 84. The processor 84 can, for example, process the information and provide motion control signals to a motion controller 86, which in turn can provide control signals to an actuator 70 for positioning one or more print heads 60 at a given point in time (relative to and coordinated with a container being moved).

It is important to note that embodiments of the system 40 are not limited to one having a separate and distinct scanning device, signal conditioner, processor, motion controller, and/or actuator. Rather, such components may be provided in various combinations or have their functions combined in various operative combinations without departing from the scope of the present invention. For example, in an embodiment, a scanning device may confirm the presence of an intended medium, develop container surface data, communicate the data, whether directly or indirectly, to the print heads (or the actuator or controller controlling the position of the print heads), and the distance between the print heads and the container surface to be printed may be controlled while the container moves past one or more print heads.

A printing subsystem 50 can be configured to control the position of one or more print heads 60 and, for a non-planar surface, can effectively maintain a defined or controlled offset with respect to the surface of the container. For example, the system 40 can be configured to maintain a standoff distance (e.g., 1 mm.+−.0.3 mm) between the portion of the print head dispensing ink and the surface of the container (e.g., surface of medium 20) that receives the droplets of ink. It is worthwhile to note that, for embodiments, the standoff distance may be said to particularly pertain to the distance between the portion of the print head 60 that provides the ink (at the time the ink is applied) and the surface of the container that receives the ink droplets (which may be a medium surface). That is, portions of a print head 60 that do not coincide to the portions of the print head that apply the ink may encroach the space associated with the standoff distance, provided, however, that such encroachment should not create a physical interference between a print head and a container.

With further reference to FIG. 1, in an embodiment of the system 40, the containers are moved at a constant or substantially constant velocity past the print heads. However, embodiments of the system can include sensors that determine, monitor, and/or control the speed of movement (i.e., the velocity V) of the containers at one or more stages in the system. The system 40 can, for example, provide such information to a processor or controller, and coordinate the movement of the print heads to adjust for the constant or non-constant movement of the containers past the print heads. Moreover, one or more feedback control systems can be incorporated into the system to serve such a control function and coordinate the position and movement of the print heads relative to a container that is moving past the print head.

For some applications, portions of the containers may be pre-treated prior to entering the printing subsystem 50 or passing a print head. Pre-treatment can be used, for instance, to increase the surface temperature of a portion of a container (such as a medium portion) to provide improved bonding with the droplets of ink. Some known pre-treating techniques include, without limitation, flame, corona, and plasma treatment. However, the invention is not limited to those pre-treatment options.

As a container 10 reaches and/or passes the printing subsystem 50, one or more print heads 60 may be configured to apply ink droplets to the medium, and/or other portions of the container, to create one or more digital image(s) of some type or form. For example, in the illustrated embodiment shown in FIG. 1, the digital image "PRINT" may be formed at a desired position on a medium 20. However, with the concept the digital image is not limited to the printing of text, and any number of single or multi-colored text, designs, or other images, or various combinations thereof are contemplated by the concept.

Additionally, while possibly not necessary or desirable with the inclusion of a medium 20, the system 40 may provide for the application of an optional base coat to a portion of the surface of a medium prior to printing a digital image. The base coat may be comprised of material that serves to improve the application of ink droplets and/or provides a visual characteristic. If desired, all or a portion of the base coat may be digitally printed on at least a portion of a surface of the medium. In an embodiment, one or more digital images are printed entirely on a base coat.

For some applications, a portion of the base coat and/or a portion of the surface of a medium may form a portion of the digital image. For example, if a portion of the intended digital image includes a color that sufficiently matches that of the surface of the medium and/or a base coat (if applicable), the printing subsystem can be programmed to controllably avoid dispersion of droplets of ink over such portions.

Individual ink droplets 30, including those associated with a single digital image, can vary in diameter from about 10 microns to about 200 microns. In a particular embodiment, the diameter of the droplets can range from about 30 microns to about 90 microns. Additionally, the application of ink drops provided on the surface of the container to form the digital images ranges from about 200 to about 1200 drops per inch (DPI) and, in an embodiment, may range from 300 to 1200 DPI. The resulting digital image formed on a container surface may, for example and without limitation, include various text and/or graphics, including color text and graphics.

Referring again to FIG. 1, the system 40 may further include a means for curing droplets of ink associated with the digital image. For example, if UV curable inks are applied, the means for curing may include one or more UV lamps 100. Moreover, the digital images printed on the surface of the container may be prescribed to be cured within a defined period. For example, in an embodiment, the digital images may be cured between 0.5 seconds and 5 seconds after the ink droplets contact the container surface.

The application system 40 may also include a post-printing scanner (which could be in the nature of illustrated scanner 80, but downstream) that scans the final digital image. The system can then evaluate the post-printing data to assess whether or not the image printed on a given container meets a prescribed or established criteria, which may generally correlate to the quality of the image. If the image printed on the container does not meet the prescribed or established criteria, a communication may be initiated (such as an alarm or notification to an operator) and the container may be routed to an area for further assessment and disposal or rework.

Embodiments of the disclosed system can provide, inter alia, a system with just-in-time, customizable digital print labeling capabilities in connection with post-labeled, and even filled and closed, containers. For example, a container that is labeled and even filled with contents, may be subsequently (i.e., at a later desired time) have a digital image (which can be varied and controlled) applied to the medium and/or other portions of the container. This can provide a significant amount of additional customization and/or flexibility to various supply and distribution networks.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A method for making a plastic article with a digitally printed image, the method comprising:

providing a plastic article having a surface;

providing a medium on at least a portion of the surface of the plastic article, the medium comprising a separately applied label as an in-mold label, a glued-upon label, a pressure-sensitive label, an adhesive label, or a heat transfer label;

moving the plastic article in a substantially vertical orientation to or by a station with a plurality of horizontally movable print heads configured for horizontal printing;

providing one or more of the plurality of horizontally movable print heads at a distance relative to the surface;

horizontally side printing, on the substantially vertically-oriented plastic article, a plurality of ink droplets on at least a portion of the separately applied label; and curing the plurality of ink droplets.

2. The method of claim 1, including confirming the presence of the medium on at least a portion of the surface.

3. The method of claim 2, wherein a scanning device is used to confirm the presence or the accurate placement of the medium.

4. The method of claim 2, wherein the presence of the medium is confirmed prior to printing the plurality of ink droplets on at least a portion of the medium.

5. The method of claim 1, including simultaneously printing the plurality of ink droplets on two different portions of the article.

6. The method of claim 1, wherein the diameter of the plurality of ink droplets ranges from about 10 microns to about 200 microns.

7. The method of claim 1, wherein the diameter of the plurality of ink droplets ranges from about 30 microns to about 90 microns.

8. The method of claim 1, wherein the plurality of ink droplets are provided with a range between about 200 to about 1200 drops per inch (DPI).

9. The method of claim 1, wherein the plurality of ink droplets are provided with a range between about 300 to about 1200 drops per inch (DPI).

10. The method of claim 1, wherein the digitally printed plurality of ink droplets form part of a digital image, and the digital image includes text, graphics, or text and graphics.

11. The method of claim 1, wherein the curing takes place between 0.5 seconds and 5 seconds after the ink droplets contact the container surface.

12. A plastic container comprising:

a plastic container;

a medium comprising a separately applied label that is applied directly to a portion of the container as an in-mold label, a glued-upon label, a pressure-sensitive label, an adhesive label, or a heat transfer label; and a digital image that is digitally printed on a portion of the separately applied label after the separately applied label has been applied to the portion of the container;

wherein the digital image is comprised of a plurality of printed ink droplets provided directly on at least a portion of the separately applied label, the ink droplets have diameters within the range of about 10 microns to about 200 microns and the ink droplets forming a digital image with a range between about 200 to about 1200 drops per inch (DPI).

13. The plastic container of claim 12, wherein the medium includes one or more pre-printed portions.

14. The plastic container of claim 12, wherein two or more separate mediums are applied to two or more different portions of the container.

15. The plastic container of claim 12, wherein the plurality of printed ink droplets are cured.

16. The plastic container of claim 12, wherein the medium is white or clear.

17. The plastic container of claim 12, wherein the medium is comprised of one or more colors.

18. The method of claim 12, including confirming the presence of the medium on at least a portion of the surface.

19. The method of claim 18, wherein the presence of the medium is confirmed prior to printing the plurality of ink droplets on at least a portion of the medium.

20. The method of claim 18, wherein a scanning device is used to confirm the presence or the accurate placement of the medium.

21. The method of claim 12, wherein the plurality of ink droplets are horizontally side printed on a vertically upstanding plastic container.

22. The method of claim 12, including simultaneously printing the plurality of ink droplets on opposing sides of the container.

* * * * *